US010522118B1

(12) United States Patent
Jones et al.

(10) Patent No.: US 10,522,118 B1
(45) Date of Patent: Dec. 31, 2019

(54) INSTRUMENT STRING LENGTH MEASUREMENT AND MARKING APPARATUS AND METHOD OF USING SAME

(71) Applicants: Casey Jones, Helotes, TX (US); Ryan Simpson, Kerrville, TX (US); Eric Albert Haddad, Boerne, TX (US)

(72) Inventors: Casey Jones, Helotes, TX (US); Ryan Simpson, Kerrville, TX (US); Eric Albert Haddad, Boerne, TX (US)

(73) Assignee: STILLWATER TOOL WERKS, LLC, Kerrville, TX (US)

( * ) Notice: Subject to any disclaimer, the term of this patent is extended or adjusted under 35 U.S.C. 154(b) by 0 days.

(21) Appl. No.: 16/295,047

(22) Filed: Mar. 7, 2019

Related U.S. Application Data

(60) Provisional application No. 62/640,561, filed on Mar. 8, 2018.

(51) Int. Cl.
*G10D 3/00* (2006.01)
*G10D 3/14* (2006.01)

(52) U.S. Cl.
CPC ..... *G10D 3/14* (2013.01); *G10D 3/006* (2013.01)

(58) Field of Classification Search
CPC ..... G10D 3/14; G10D 3/006
See application file for complete search history.

(56) References Cited

U.S. PATENT DOCUMENTS 762,723 A * 6/1904 Hutchins ..... G10D 3/14 84/458
3,706,254 A * 12/1972 Morin ..... G10D 3/006 84/458
4,278,002 A * 7/1981 Siminoff ..... G10D 3/006 74/547
7,301,089 B1 * 11/2007 Liao ..... G10D 3/006 84/453
8,481,831 B2 * 7/2013 Tanabe ..... G10D 3/14 84/293
9,076,412 B1 * 7/2015 Rolling ..... G10D 3/146
9,305,526 B1 * 4/2016 Kim ..... G10D 3/006
9,390,691 B2 * 7/2016 Curran ..... G10D 3/006
10,297,235 B2 * 5/2019 Rognlien ..... G10D 3/006

FOREIGN PATENT DOCUMENTS

JP 3131642 U 5/2007

* cited by examiner

*Primary Examiner* — Robert W Horn
(74) *Attorney, Agent, or Firm* — Taboada Law Firm, PLLC; John M. Taboada

(57) ABSTRACT

Methods and systems for stringing an instrument are disclosed, including coupling a string to a bridge; threading the string through a tuning member; providing a device comprising: a body having a proximal and distal end; and slots into the body located between the proximal end and the distal end; wherein distances between the proximal end and the slots correspond to predetermined string lengths beyond tuning members of the instrument; and wherein each of the slots comprises a marking edge; positioning the proximal end against the tuning member; inserting string threaded through the tuning member into one of the slots; pulling the string toward the bridge to mark the string; removing the device from the tuning member; pulling the string back through the tuning member towards the bridge until the mark is proximate the tuning member; and winding the string around the tuning member. Other embodiments are described and claimed.

16 Claims, 9 Drawing Sheets

INSTRUMENT STRING LENGTH MEASUREMENT AND MARKING APPARATUS AND METHOD OF USING SAME

I. CROSS REFERENCE TO RELATED APPLICATIONS

This application claims the benefit of the filing date of U.S. Provisional Patent Application Ser. No. 62/640,561, filed on Mar. 8, 2018, entitled "Stringed Instrument String Measurement Apparatus and Method," the entire disclosure of which is hereby incorporated by reference into the present disclosure.

II. BACKGROUND

The invention relates generally to the field of tools for musical stringed instruments. More particularly, the invention relates to a method and apparatus for extracting string retention pins, measuring and marking optimal string length, and winding new strings onto tuning posts or pegs.

III. SUMMARY

In one respect, disclosed is an instrument string length measuring and marking device comprising: a body having a proximal end and a distal end opposite the proximal end; and one or more slots into the body located between the proximal end and the distal end of the body; wherein one or more distances between the proximal end of the body and the one or more slots correspond to one or more predetermined string lengths beyond one or more tuning members of an instrument; and wherein each of the one or more slots comprises a marking edge configured to mark the instrument string at the one or more predetermined string lengths.

In another respect, disclosed is a method for stringing an instrument, comprising: coupling a first end of a string to a bridge of the instrument; threading a second end of the string through a tuning member of the instrument; providing an instrument string length measuring and marking device comprising: a body having a proximal end and a distal end opposite the proximal end; and one or more slots into the body located between the proximal end and the distal end of the body; wherein one or more distances between the proximal end of the body and the one or more slots correspond to one or more predetermined string lengths beyond one or more tuning members of the instrument; and wherein each of the one or more slots comprises a marking edge configured to mark the instrument string at the one or more predetermined string lengths; positioning the proximal end of the body of the instrument string length measuring and marking device against the tuning member of the instrument having the threaded string; inserting string threaded through the tuning member into one of the one or more slots of the instrument string length measuring and marking device which corresponds to the string being strung; pulling the second end of the string toward the bridge of the instrument to mark the string with a visible bend and/or kink; removing the instrument string length measuring and marking device from the tuning member; pulling the string back through the tuning member towards the bridge until the visible bend and/or kink is proximate the tuning member; and winding the string around the tuning member by turning a tuning nut which corresponds to the threaded tuning member.

Numerous additional embodiments are also possible.

IV. BRIEF DESCRIPTION OF THE DRAWINGS

Other objects and advantages of the invention may become apparent upon reading the detailed description and upon reference to the accompanying drawings.

Figure 1:
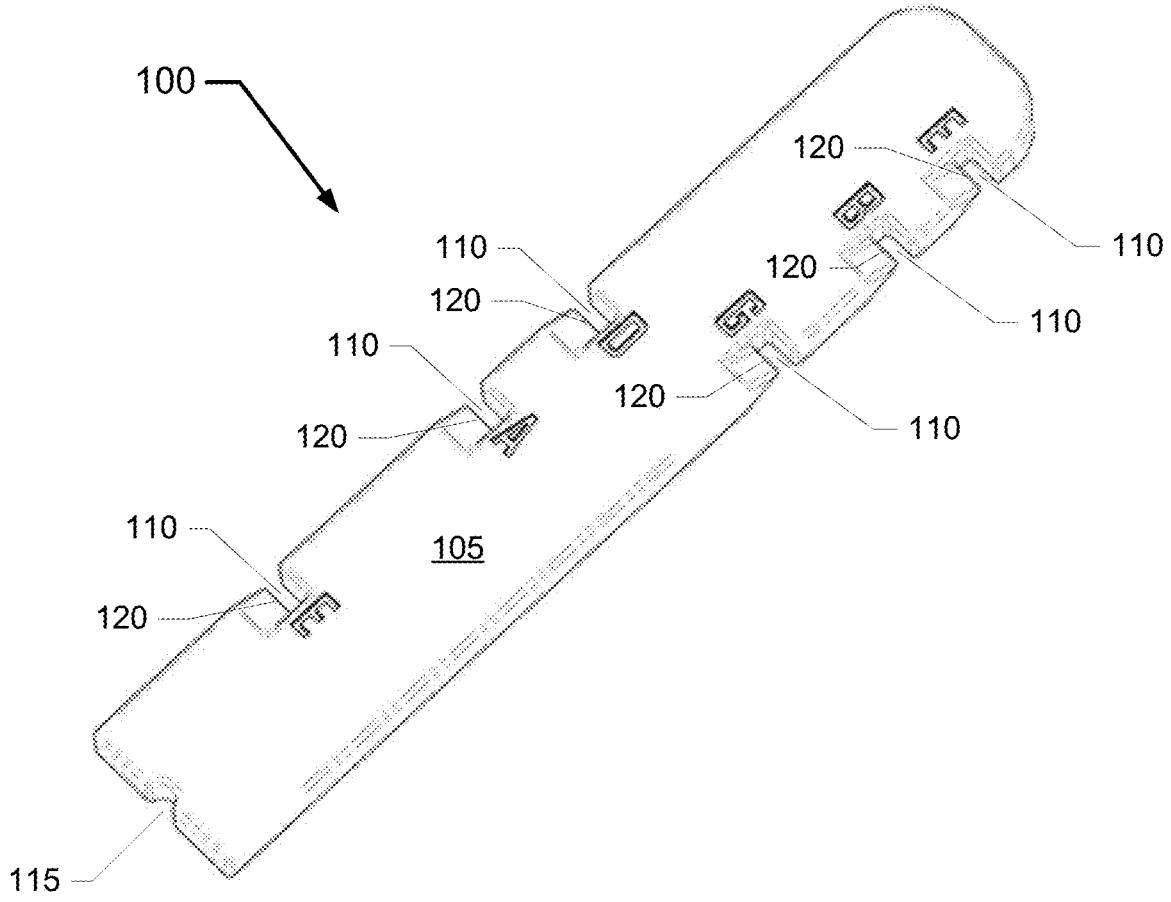
FIG. 1 is a side perspective of an instrument string length measuring and marking device, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it would be impossible or impractical to include all of the possible embodiments and contexts of the invention in this disclosure. Upon reading this disclosure, many alternative embodiments of the present invention will be apparent to persons of ordinary skill in the art.

String instruments such as acoustic guitars, electric guitars, violins, violas, etc. require periodic string replacement due to wear and breakage. Some of these instruments have tuning members such as tuning posts or tuning pegs onto which the strings are wound onto and determining where along the new string to start winding varies depending on the particular instrument and string to be wound. Some users resort to using rulers or even eyeballing it to determine where along the new string to start winding. Unfortunately, neither of these or other similar methods are effective and may result in inconsistent tuning, string damage, decreased string life, and an overly complicated stringing process. The embodiment or embodiments described herein may solve these problems as well as others by proposing a novel optimal string length measuring and marking apparatus for stringed instruments and method of using the same.

FIG. 1 is a side perspective of an instrument string length measuring and marking device, in accordance with some embodiments.

Figure 2:
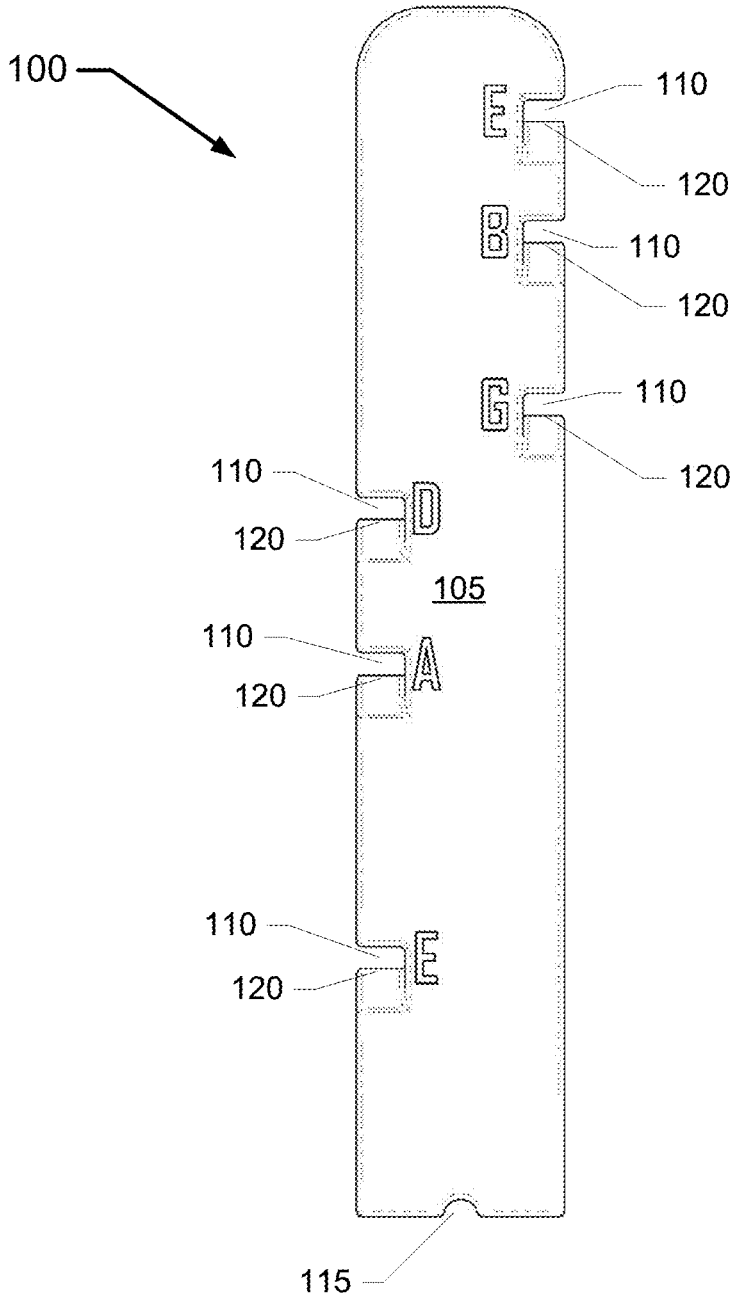
FIG. 2 is a top perspective of the instrument string length measuring and marking device, in accordance with some embodiments.

FIG. 2 is a top perspective of the instrument string length measuring and marking device, in accordance with some embodiments.

In some embodiments, the string length measuring and marking device 100 comprises a body 105 having a proximal end and a distal end opposite the proximal end, one or more slots or cutouts 110 into the body, and a notch 115 at the proximal end. In some embodiments, the notch is not present and the proximal end is used to contact the tuning member. In some embodiments, one side of each of the one or more slots 110 may comprise a marking edge 120 over which the string may be marked with a visible bend and/or kink. The one or more slots may be labeled with the letter for the string they correspond to. For example, for a six-string guitar, the slot closest to the notch 115 would correspond to the optimal length for the low E string of the guitar, followed by the slots for the A string, D string, G string, B string, and lastly the high E string which is the furthest from the notch 115. In order to maximize tuning retention of the instrument, each string needs to be wound around the tuning member a certain predetermined number of times. Generally, as the diameter of the string decreases, the number of windings around the tuning member needs to be increased. For the optimal string length of a six-string guitar, the low E string should have approximately two windings around the tuning member, the A string should have approximately three windings around the tuning member, the D string should have approximately four windings around the tuning member, the G string should have approximately five windings around the tuning member, the B string should have approximately six windings around the tuning member, and the high E string should have approximately seven windings around the tuning member. Using the optimal string length to achieve these particular predetermined number of windings around the posts for each of the strings results in an instrument with more consistent tuning and increased string life. The string length measuring and marking device illustrated in FIG. 1 and FIG. 2 is for use with a six-string instrument, but other string length measuring and marking devices may be configured for use with other stringed instruments.

In some embodiments, body 105 is formed of a monolithic piece of rigid material, such as (but not limited to) metal, wood, plastic, polycarbonate, compounds thereof and the like, all of which are well known in the art for their suitability for gadgets and tools for stringed instruments.

Figure 3:
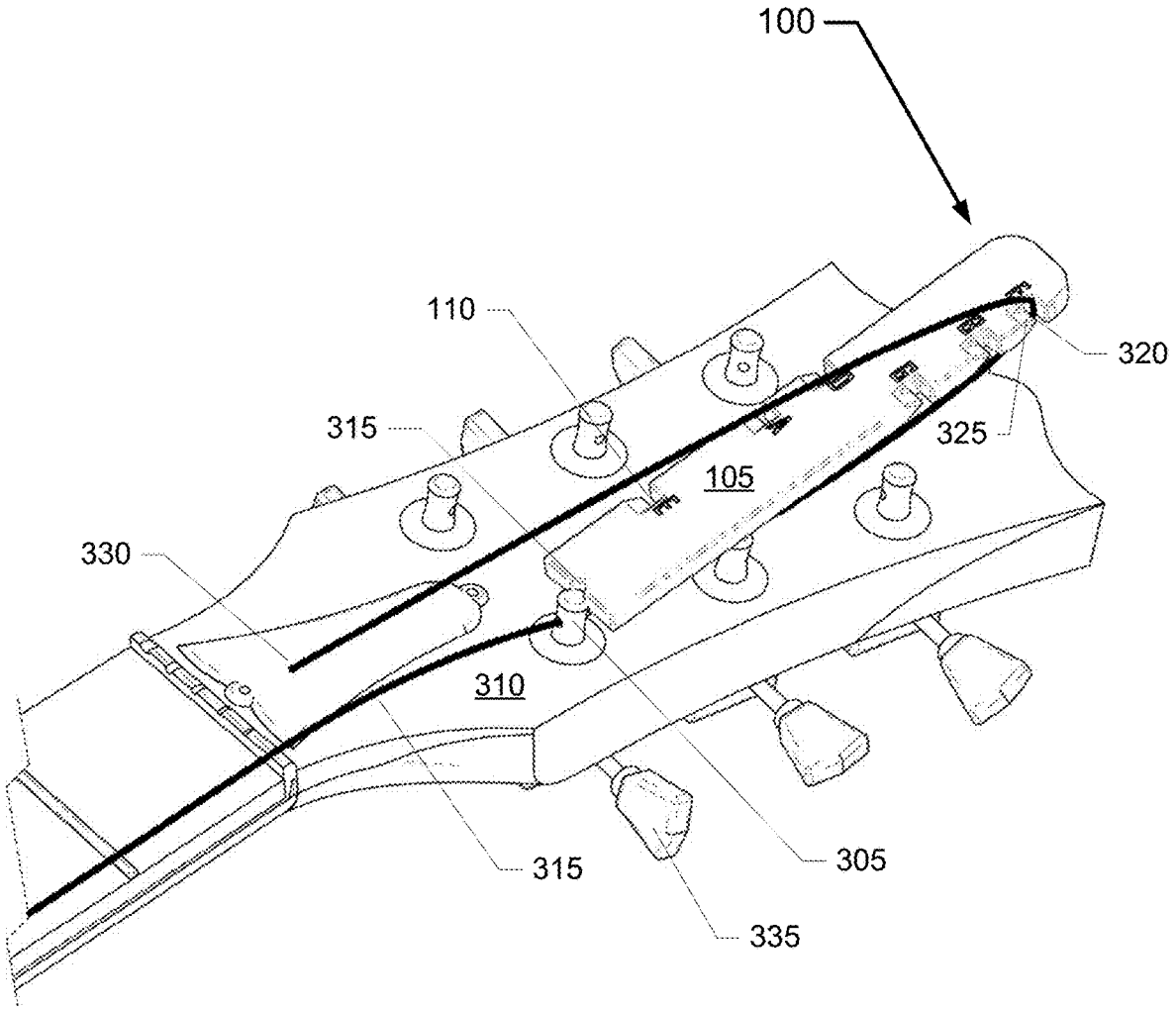
FIG. 3 is a side perspective showing the instrument string length measuring and marking device in use, in accordance with some embodiments.

FIG. 3 is a side perspective showing the instrument string length measuring and marking device in use, in accordance with some embodiments.

In some embodiments, the string length measuring and marking device 100 comprises a body 105 having a proximal end and a distal end opposite the proximal end, one or more slots or cutouts 110 into the body, and a notch 115 at the proximal end. In some embodiments, one side of each of the one or more slots may comprise a marking edge over which the string may be marked with a visible bend and/or kink. The one or more slots may be labeled with the letter for the string they correspond to. For example, for a six-string guitar, the slot closest to the notch 115 would correspond to the optimal length for the low E string the guitar, followed by the slots for the A string, D string, G string, B string, and lastly the high E string which is the furthest from the notch 115. The string length measuring and marking device 100 is used by placing the notch 115 if present and if not the proximal end against the tuning member 305 which in the embodiment illustrated in FIG. 3 extends from the headstock 310 of the guitar. In this embodiment, the notch 315 of the device 100 is positioned against the tuning member 305 of the high E string and the high E string 315 is threaded through the tuning member 305 and into the slot 320 for the high E string. The free end 330 of the high E string is then pulled toward the bridge of the guitar which results in a visible bend or kink of the high E string due to the marking edge 325 within the slot 320. Once the string has been marked with a visible bend or kink, the string 315 is pulled through the tuning member 305 towards the bridge until the visible end or kink mark reaches the tuning member 305 at which point the user may begin to wind the string onto the tuning member by turning the tuning nut 335. The same process may be used for the other strings of the guitar, low E, A, D, G, and B, but by using their corresponding slots 110 to mark the strings with a visible bend or kink. Using the string length measuring and marking device reduces the time and effort to restring an instrument, eliminates the potential damage to the strings during the restringing process, and results in consistent string length, improved tuning retention, and extended string life.

Figure 4:
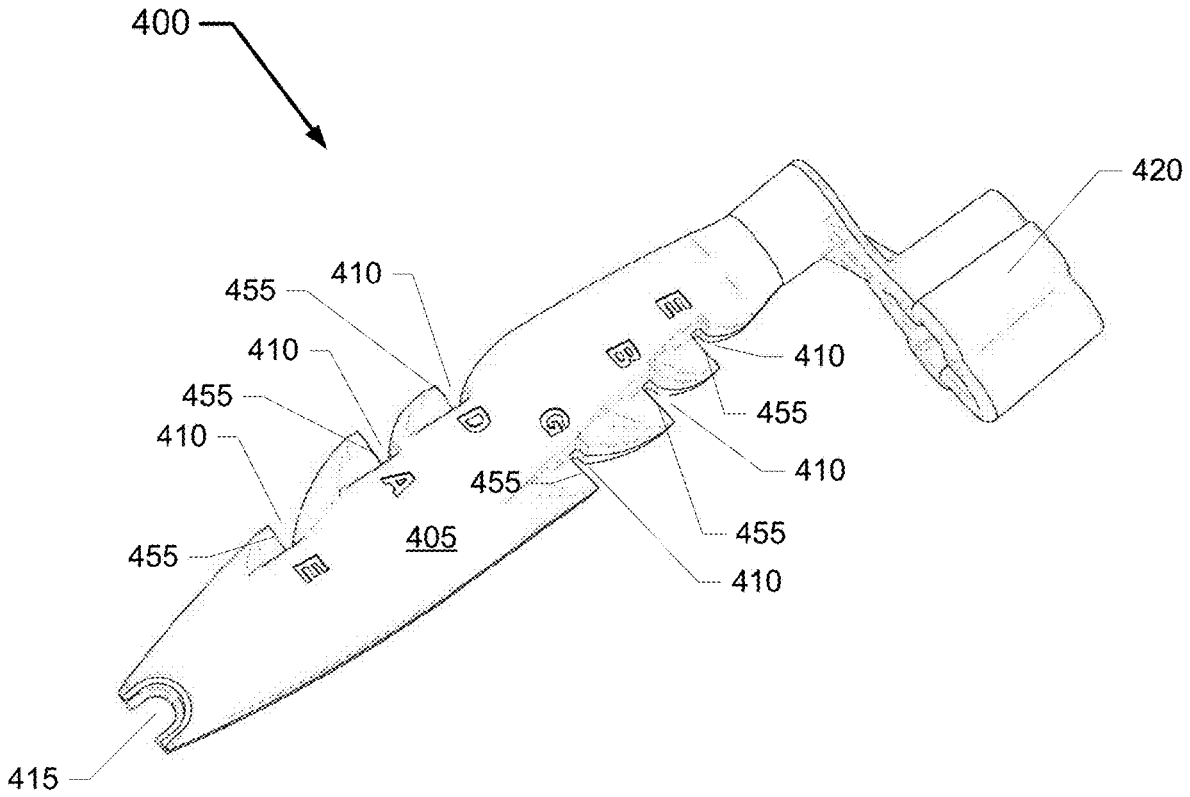
FIG. 4 is a side perspective of an instrument string length measuring and marking device, in accordance with some embodiments.

FIG. 4 is a side perspective of an instrument string length measuring and marking device, in accordance with some embodiments.

Figure 5:
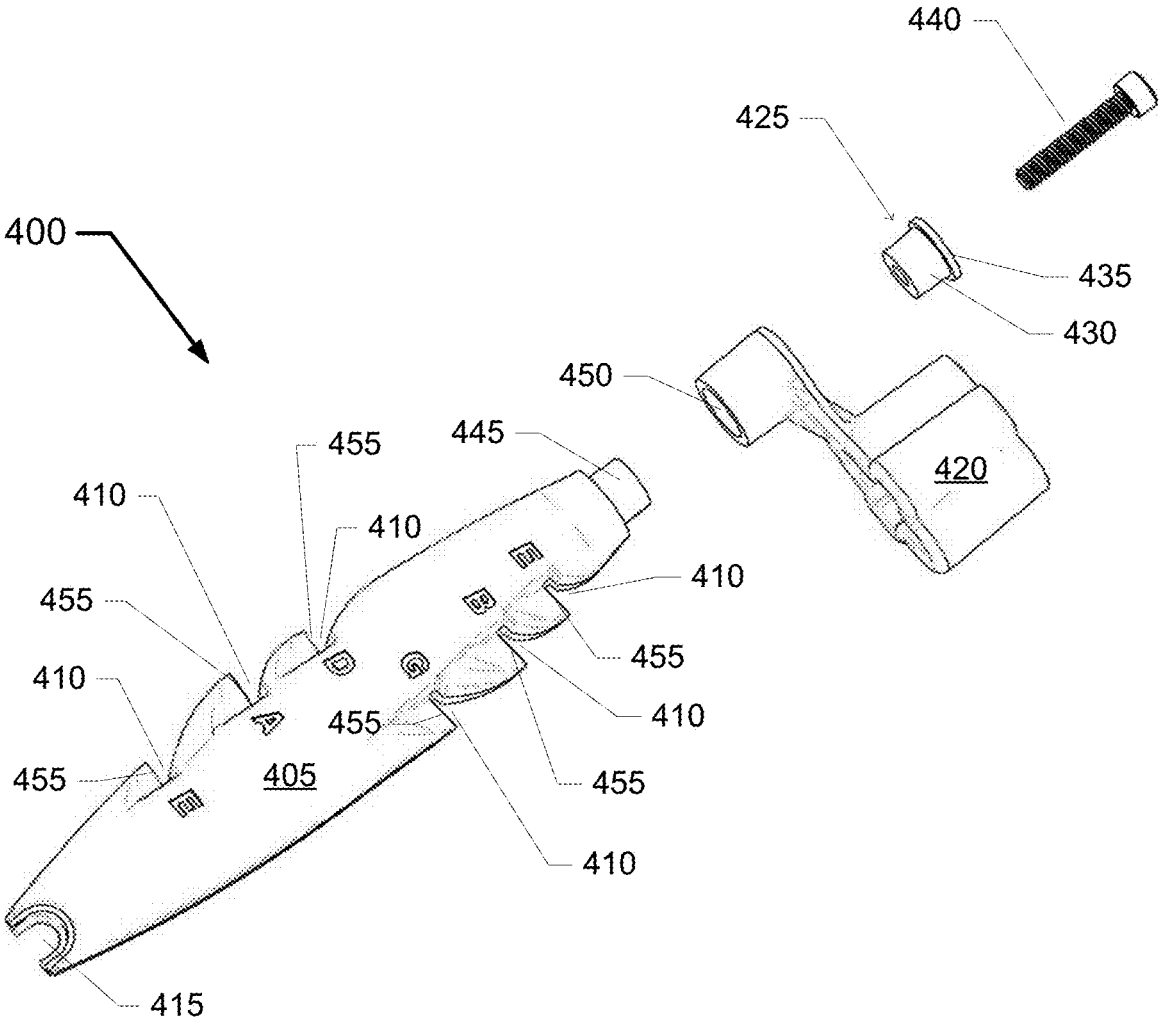
FIG. 5 is an exploded side perspective of the instrument string length measuring and marking device, in accordance with some embodiments.

FIG. 5 is an exploded side perspective of the instrument string length measuring and marking device, in accordance with some embodiments.

Figure 6:
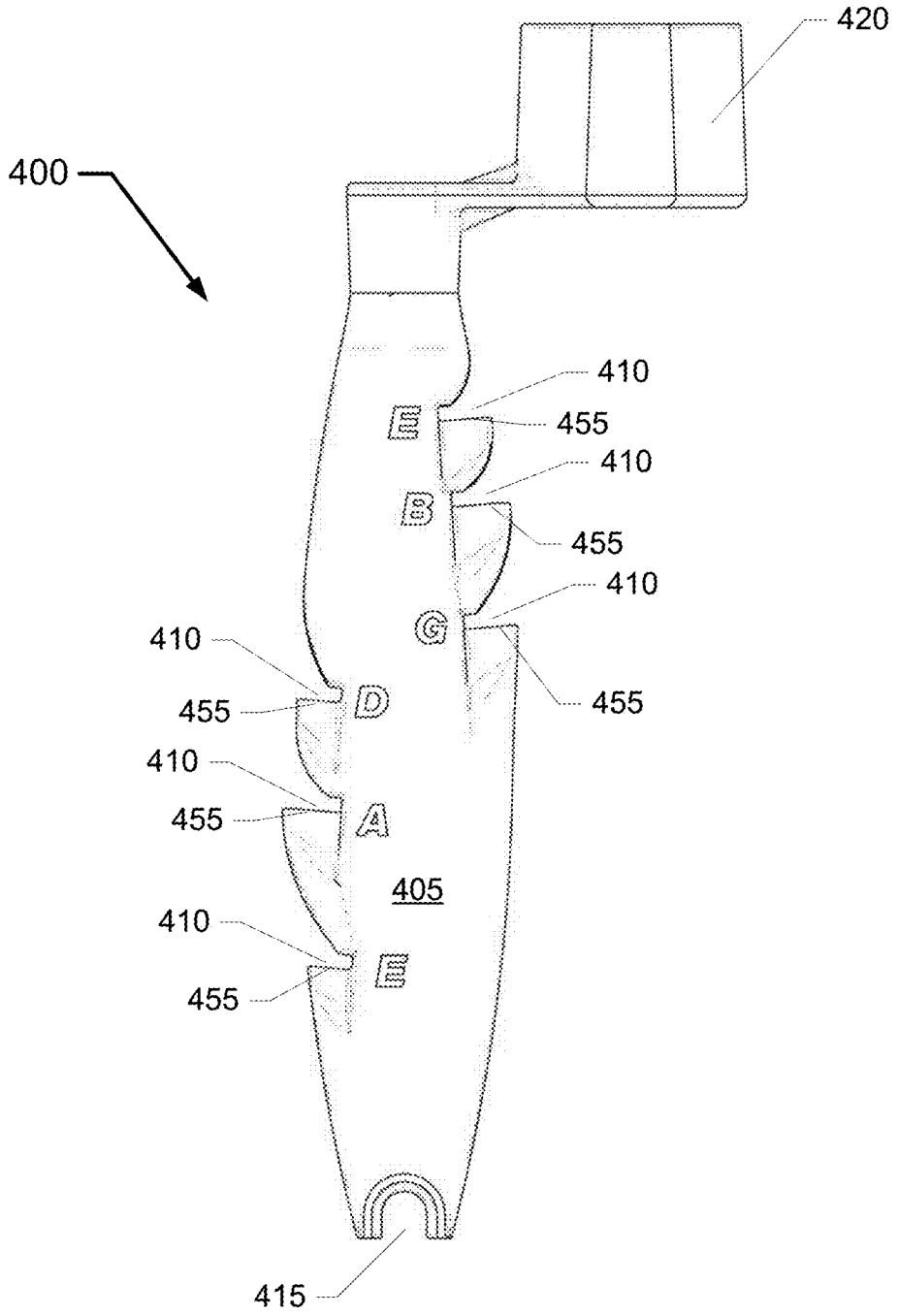
FIG. 6 is a top perspective of the instrument string length measuring and marking device, in accordance with some embodiments.

FIG. 6 is a top perspective of the instrument string length measuring and marking device, in accordance with some embodiments.

In some embodiments, the string length measuring and marking device 400 comprises a body 405 having a proximal end and a distal end opposite the proximal end, one or more slots or cutouts 410 into the body, a notch 415 at the proximal end, and a rotatably coupled tuning nut receiver or coupler 420 at the distal end. The rotatably coupled tuning nut receiver 420 may be rotatably coupled to the body 405 with a retaining axle 425 having an axle portion 430 and a retaining portion 435 secured to the body with a screw 440. The diameter of the axle portion 430 of the retaining axle 425 and the diameter of a distal portion 445 of the body 405 are configured to loosely fit into the axle opening 450 of the tuning nut receiver 420. In an alternate embodiment, a screw having an integrated axle portion and retaining portion may be used as the entire axle for the tuning nut receiver 420.

In some embodiments, one side of each of the one or more slots 410 may comprise a marking edge 455 over which the string may be marked with a visible bend and/or kink. The one or more slots may be labeled with the letter for the string they correspond to. For example, for a six-string guitar, the slot closest to the notch 415 would correspond to the optimal length for the low E string the guitar, followed by the slots for the A string, D string, G string, B string, and lastly the high E string which is the furthest from the notch 415. In order to maximize tuning retention of the guitar, each string needs to be wound around the tuning member a certain predetermined number of times. Generally, as the diameter of the string decreases, the number of windings around the tuning member needs to be increased. For the optimal string length of a six-string guitar, the low E string should have approximately two windings, the A string should have approximately three windings, the D string should have approximately four windings, the G string should have approximately five windings, the B string should have approximately six windings, and the high E string should have approximately seven windings. Using the optimal string length to achieve these particular predetermined number of windings around the tuning member for each of the strings results in an instrument with more consistent tuning and increased string life. The string length measuring and marking device illustrated in FIG. 4, FIG. 5, and FIG. 6 is for use with a six-string guitar, but other string length measuring and marking devices may be configured for use with other stringed instruments.

In some embodiments, the notch 415 may be configured to also be used as a tool to extract the bridge pins in order to pull the string from the bridge of the instrument. This notch configuration may also added to the embodiment illustrated in FIG. 1, FIG. 2, and FIG. 3.

In some embodiments, body 405, tuning nut receiver 420, retaining axle 425, and screw 440 are formed of monolithic pieces of rigid material, such as (but not limited to) metal, wood, plastic, polycarbonate, compounds thereof and the like, all of which are well known in the art for their suitability for gadgets, tools, and hardware for stringed instruments.

Figure 7:
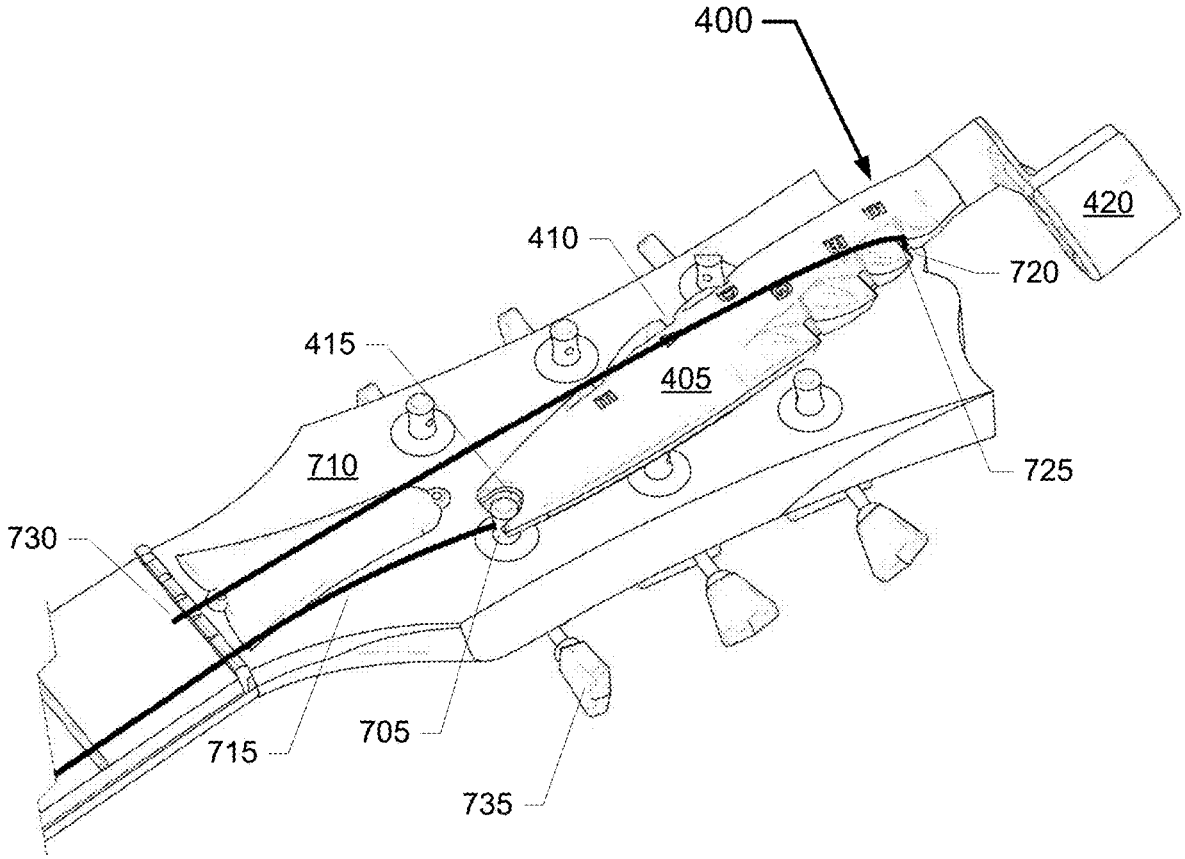
FIG. 7 is a side perspective showing the string length measuring and marking device in use, in accordance with some embodiments.

FIG. 7 is a side perspective showing the string length measuring and marking device in use, in accordance with some embodiments.

In some embodiments, the string length measuring and marking device 400 comprises a body 405 having a proximal end and a distal end opposite the proximal end, one or more slots or cutouts 410 into the body, a notch 415 at the proximal end, and a rotatably coupled tuning nut receiver 420 at the distal end. The rotatably coupled tuning nut receiver 420 may be rotatably coupled to the body 405 with a retaining axle having an axle portion and a retaining portion secured to the body with a screw. The diameter of the axle portion of the retaining axle and the diameter of a distal portion of the body are configured to loosely fit into the axle opening of the tuning nut receiver 420. In an alternate embodiment, a screw having an integrated axle portion and retaining portion may be used as the entire axle for the tuning nut receiver 420.

Figure 8:
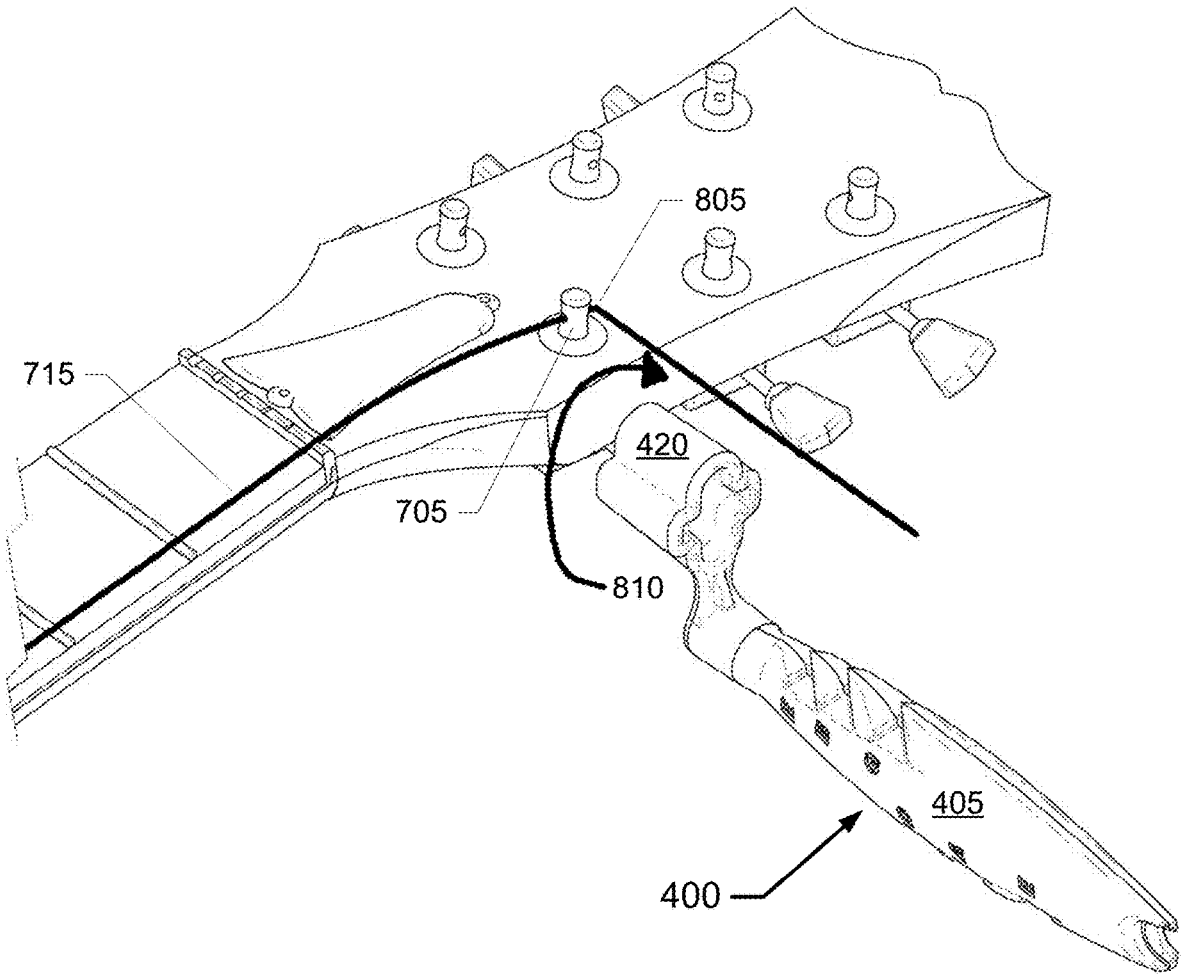
FIG. 8 is a side perspective showing the string length measuring and marking device in use, in accordance with some embodiments.

In some embodiments, one side of each of the one or more slots may comprise a marking edge over which the string may be marked with a visible bend and/or kink. The one or more slots may be labeled with the letter for the string they correspond to. For example, for a six-string guitar, the slot closest to the notch 415 would correspond to the optimal length for the low E string the guitar, followed by the slots for the A string, D string, G string, B string, and lastly the high E string which is the furthest from the notch 415. The string length measuring and marking device 400 is used by placing the notch 415 if present and if not the proximal end against the tuning member 705 which in the embodiment illustrated in FIG. 7 extends from the headstock 710 of the guitar. In this embodiment, the notch 415 of the device 400 is positioned against the tuning member 705 of the high E string and the high E string 715 is threaded through the tuning member 705 and into the slot 720 for the high E string. The free end 730 of the high E string is then pulled toward the bridge of the guitar which results in a visible bend or kink of the high E string due to the marking edge 725 within the slot 720. Once the string has been marked with a visible bend or kink, the string 715 is pulled through the tuning member 705 towards the bridge until the visible bend or kink mark reaches the tuning member 705 at which point the user may begin to wind the string onto the tuning member by turning the tuning nut 735. FIG. 8 illustrates how the string length measuring and marking device 400 may be used to turn the tuning nut 735. The same process may be used for the other strings of the guitar, low E, A, D, G, and B, but by using their corresponding slots 410 to mark the strings with a visible bend or kink. Using the string length measuring and marking device reduces the time and effort to restring an instrument, eliminates the potential damage to the strings during the restringing process, and results in consistent string length, improved tuning retention, and extended string life.

FIG. 8 is a side perspective showing the string length measuring and marking device in use, in accordance with some embodiments.

In some embodiments, the string length measuring and marking device 400 may be used to wind the string 715 around the tuning member 705 after the string has been marked with a visible bend or kink 805. After the string has been marked as shown in FIG. 7, the string is adjusted so that the mark 805 is positioned proximate the tuning member 705. Next the corresponding tuning nut for the tuning member 705 is inserted into the tuning nut receiver 420 and the body 405 of the string length measuring and marking device 400 is rotated about the central axis of the tuning nut, as illustrated in arrow 810, to wind the slack of the string between the bridge and the tuning member of the guitar around the tuning member. For the high E string illustrated in FIG. 8, the string 715 will be wound approximately seven times around the tuning member.

Figure 9:
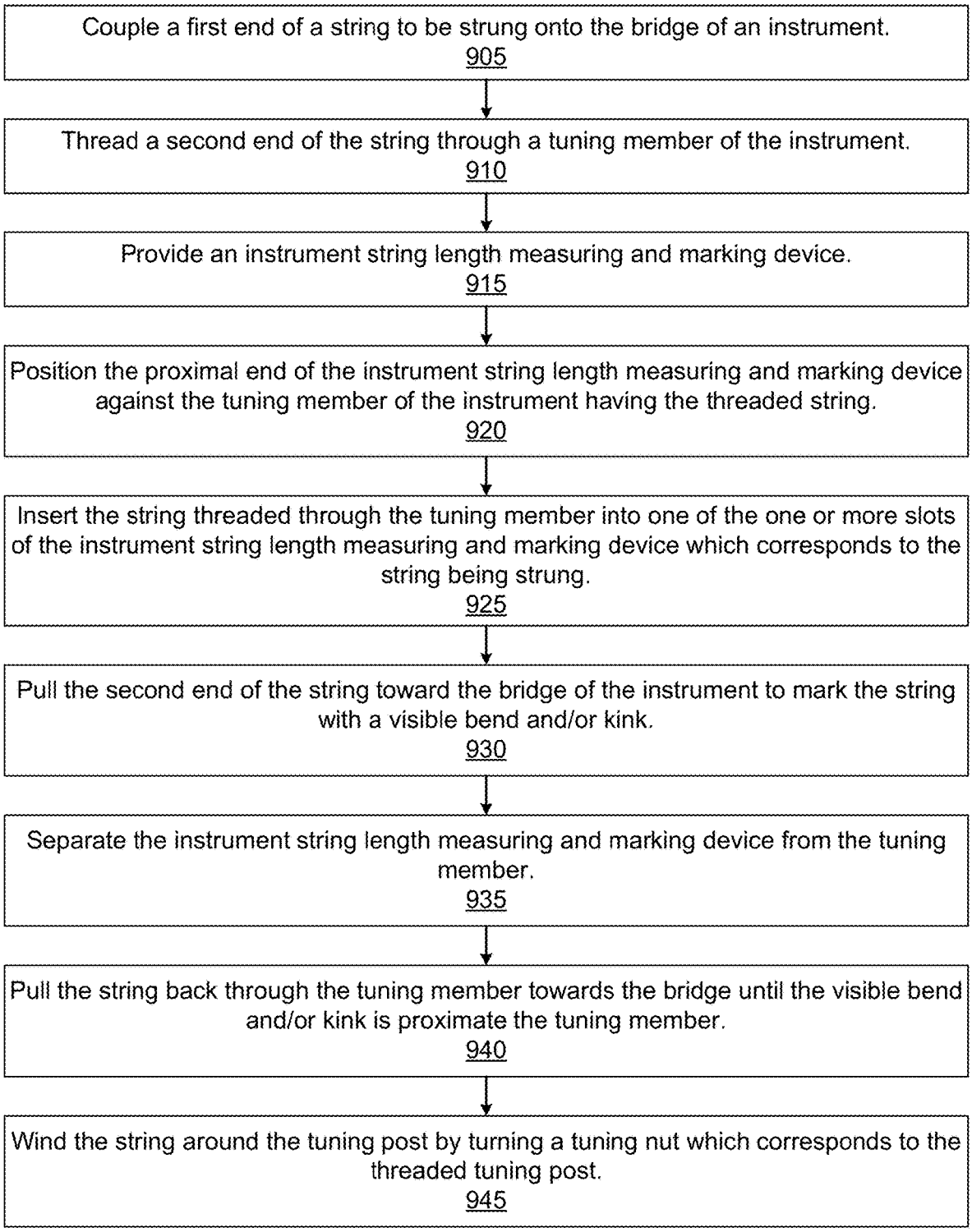
FIG. 9 is a flowchart illustrating a method for using an instrument string length measuring and marking device, in accordance with some embodiments.

FIG. 9 is a flowchart illustrating a method for using an instrument string length measuring and marking device, in accordance with some embodiments. In some embodiments, the method illustrated in FIG. 9 may be performed by one or more of the devices illustrated in FIG. 1, FIG. 2, FIG. 3, FIG. 4, FIG. 5, FIG. 6, FIG. 7, and FIG. 8.

According to one embodiment of the present invention, the method begins at block 905, where a first end of a string to be strung onto an instrument is coupled to the bridge of the instrument. Next, at block 910, the second end of the string is threaded through a tuning member of the instrument. At block 915, an instrument string length measuring and marking device is provided. At block 920, the proximal end of the instrument string length measuring and marking device is positioned against the tuning member of the instrument having the threaded string. At block 925, the string threaded through the tuning member is inserted into one of the one or more slots of the instrument string length measuring and marking device which corresponds to the string to be strung. At block 930, the second end of the string is pulled toward the bridge of the instrument to mark the string with a visible bend and/or kink depending on the amount of force the second end of the string is pulled with. Once the string was been marked, at block 935, the string length measuring and marking device is separated from the tuning member. Next, at block 940, the string is pulled back through the tuning member towards the bridge until the visible bend and/or kink is proximate the tuning member. Lastly, at block 945, the string is wound around the tuning member by turning the corresponding tuning nut of the instrument, either by hand or in some embodiments by inserting the tuning nut into the tuning nut receiver of the string length measuring and marking device and rotating the body of the string length measuring and marking device about the central axis of the tuning nut. Although the flowchart may describe the operations as a sequential process, the order of the operations of block 910, block 915, and block 920 may be rearranged.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions, and improvements to the embodiments described above are possible. It is contemplated that these variations, modifications, additions, and improvements fall within the scope of the invention as detailed within the following claims.

The invention claimed is:

1. An instrument string length measuring and marking device comprising:

a body having a proximal end and a distal end opposite the proximal end; and one or more slots into the body located between the proximal end and the distal end of the body;

wherein one or more distances between the proximal end of the body and the one or more slots correspond to one or more predetermined string lengths beyond one or more tuning members of an instrument; and wherein each of the one or more slots comprises a marking edge configured to mark the instrument string at the one or more predetermined string lengths.

2. The instrument string length measuring and marking device of claim 1, further comprising a notch into the proximal end of the body.

3. The instrument string length measuring and marking device of claim 2, wherein the notch is configured to extract bridge pins.

4. The instrument string length measuring and marking device of claim 1, further comprising a tuning nut receiver rotatably coupled to the distal end of the body.

5. The instrument string length measuring and marking device of claim 1, wherein the one or more distances between the proximal end of the body and the one or more slots correspond to the one or more predetermined string lengths beyond the one or more tuning members for a guitar having a low E string, an A string, a D string, a G string, a B string, and a high E string.

6. The instrument string length measuring and marking device of claim 5, wherein the one or more predetermined string lengths correspond to the low E string having about two windings around the tuning member for the low E string, an A string having about three windings around the tuning member for the A string, a D string having about four windings around the tuning member for the D string, a G string having about five windings around the tuning member for the G string, a B string having about six windings around the tuning member for the B string, and a high E string having about seven windings around the tuning member for the high E string.

7. The instrument string length measuring and marking device of claim 1, further comprising one or more labels for the one or more slots.

8. The instrument string length measuring and marking device of claim 1, wherein a material of the body comprises at least one of a metal, a wood, and a plastic.

9. A method for stringing an instrument, comprising:

coupling a first end of a string to a bridge of the instrument;

threading a second end of the string through a tuning member of the instrument;

providing an instrument string length measuring and marking device comprising:

a body having a proximal end and a distal end opposite the proximal end; and one or more slots into the body located between the proximal end and the distal end of the body;

wherein one or more distances between the proximal end of the body and the one or more slots correspond to one or more predetermined string lengths beyond one or more tuning members of the instrument; and wherein each of the one or more slots comprises a marking edge configured to mark the instrument string at the one or more predetermined string lengths;

positioning the proximal end of the body of the instrument string length measuring and marking device against the tuning member of the instrument having the threaded string;

inserting string threaded through the tuning member into one of the one or more slots of the instrument string length measuring and marking device which corresponds to the string being strung;

pulling the second end of the string toward the bridge of the instrument to mark the string with a visible bend and/or kink;

removing the instrument string length measuring and marking device from the tuning member;

pulling the string back through the tuning member towards the bridge until the visible bend and/or kink is proximate the tuning member; and winding the string around the tuning member by turning a tuning nut which corresponds to the threaded tuning member.

10. The method of claim 9, wherein the instrument string length measuring and marking device further comprises a notch into the proximal end of the body.

11. The method of claim 10, wherein the notch is configured to extract bridge pins.

12. The method of claim 9, wherein the instrument string length measuring and marking device further comprises a tuning nut receiver rotatably coupled to the distal end of the body.

13. The method of claim 9, wherein the one or more distances between the proximal end of the body and the one or more slots correspond to the one or more predetermined string lengths beyond the one or more tuning members for a guitar having a low E string, an A string, a D string, a G string, a B string, and a high E string.

14. The method of claim 13, wherein the one or more predetermined string lengths correspond to the low E string having about two windings around the tuning member for the low E string, an A string having about three windings around the tuning member for the A string, a D string having about four windings around the tuning member for the D string, a G string having about five windings around the tuning member for the G string, a B string having about six windings around the tuning member for the B string, and a high E string having about seven windings around the tuning member for the high E string.

15. The method of claim 9, further comprising one or more labels for the one or more slots.

16. The method of claim 9, wherein a material of the body comprises at least one of a metal, a wood, and a plastic.

* * * * *